United States Patent [19]

Glaser

[11] Patent Number: 4,694,912

[45] Date of Patent: Sep. 22, 1987

[54] CONTROLLED IMPACT POWER TOOL

[75] Inventor: Donald A. Glaser, Emporia, Kans.

[73] Assignee: Glendo Corporation, Emporia, Kans.

[21] Appl. No.: 836,224

[22] Filed: Feb. 28, 1986

Related U.S. Application Data

[63] Continuation of Ser. No. 667,074, Nov. 1, 1984, abandoned, which is a continuation of Ser. No. 413,541, Aug. 13, 1982, abandoned.

[51] Int. Cl.[4] ..... B25D 9/26

[52] U.S. Cl. ..... 173/115; 173/115; 173/121; 60/387; 60/593

[58] Field of Search ..... 173/115, 116, 119–121, 173/139; 30/164.9, 367; 63/26; 60/371, 376, 387, 593

[56] References Cited

U.S. PATENT DOCUMENTS

| | | | |
|---|---|---|---|
| 969,354 | 9/1910 | Zelumbe | 173/116 |
| 1,446,547 | 2/1923 | Crowe | 137/625.22 |
| 2,392,560 | 1/1946 | Vitoux | 173/116 |
| 2,669,840 | 2/1954 | Joy | 60/371 |
| 2,876,742 | 3/1959 | Sherrill et al. | 91/39 |
| 2,969,772 | 1/1961 | Cahill | 91/39 |
| 3,393,755 | 7/1968 | Glaser . | |
| 3,605,915 | 9/1971 | Gately et al. | 173/116 |

*Primary Examiner*—Donald R. Schran
*Assistant Examiner*—James L. Wolfe
*Attorney, Agent, or Firm*—Schmidt, Johnson, Hovey & Williams

[57] ABSTRACT

An impact power tool for delicate hand working operations is provided which is especially adapted for detailed engraving, carving, and delicate stone setting applications. The power tool preferably includes a hand-held impact device, a piston received within the body of the device and shiftable therein for delivering impact energy to the device, conduit for delivering and venting motive fluid from and to the hand-held device for shifting of the piston, and a valve coupling the directing and venting conduits to the device in alternative fashion at rapid, variable, cyclical rate. The impact tool may be operated by connection to a standard source of pressurized air. The tool is capable of providing a greater range of impact strokes per second than conventional hand-held controlled impact tools, and thereby provides expanded capability for extremely delicate and fine engraving, carving and stone setting work.

6 Claims, 9 Drawing Figures

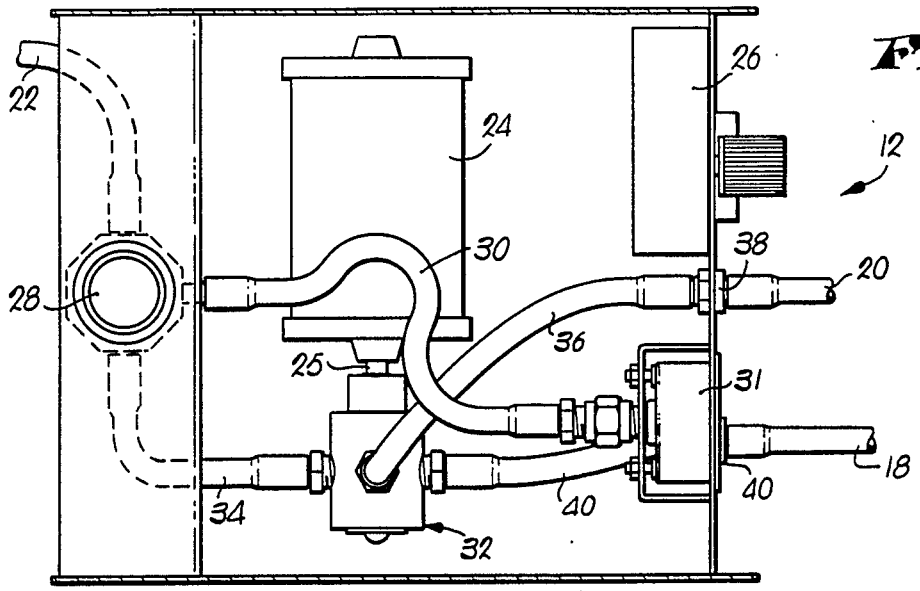
Fig.5.
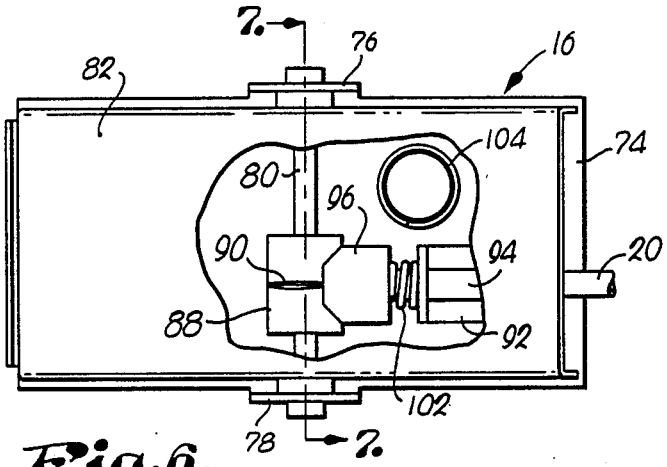
Fig.6.
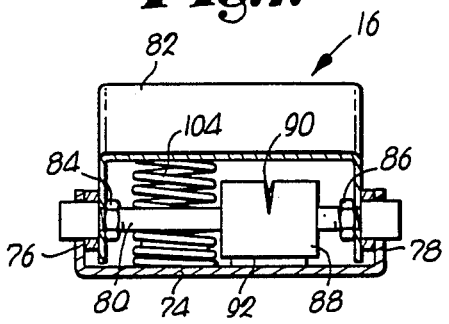
Fig.7.
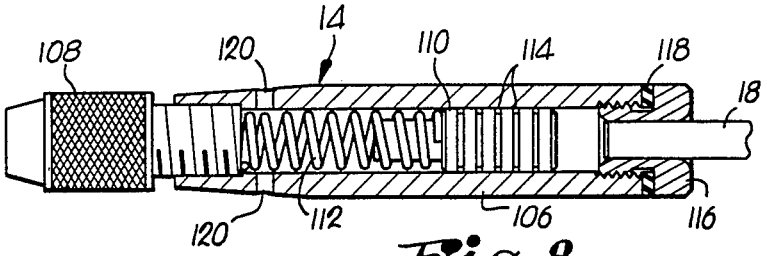
Fig.8.
Fig.9.
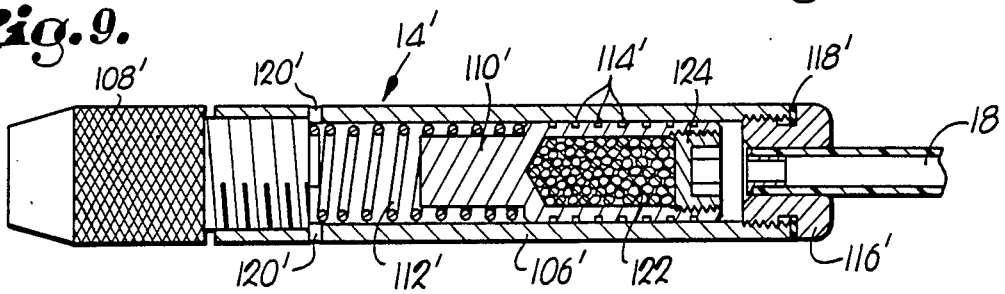

CONTROLLED IMPACT POWER TOOL

This application is a continuation of application Ser. No. 667,074, filed Nov. 1, 1984, which is a continuation of Ser. No. 413,541, filed Aug. 13, 1982 both now abandoned.

BACKGROUND OF THE INVENTION

1. Field of the Invention

This invention relates to an impact tool of simple yet highly effective construction which has numerous advantages including easy portability, compactness, and the ability to be used in extremely detailed, precise and fine engraving, carving, and stone setting work. More particularly, it is concerned with an impact tool having a hand-held impact device having a cylindrical, hollow body and a piston received within the body for delivering impact energy to the device, conduit for directing and venting motive fluid to and from the hand-held impact device for shifting of the piston therein, and a valve especially adapted for operably coupling the directing and venting conduit to the hand-held device in alternative fashion at a variable, rapid rate.

2. Description of the Prior Art

Power impact tools for engraving, carving or cutting metals, wood, stone and the like are well known in the art. U.S. Pat. No. 3,393,755, for instance, for which I was co-inventor, discloses such an impact too. Previous impact tools, however, have been somewhat limited in applications involving highly delicate, precision engraving work or stone setting due to a relatively limited range in power and stroke speed range. Highly delicate work requires an impact tool that delivers a low impact energy level for each stroke of the tool and that is capable of delivering such low impact strokes at a rapid rate. Moreover, previous hand-held impact tools have required a specialized source of pressurized motive fluid that alternatively provided a positive pressure and a vacuum to the hand-held impact device.

SUMMARY OF THE INVENTION

The problems outlined above are in large measure solved by the impact tool in accordance with the present invention. That is to say, the impact tool hereof is capable of providing a low energy impact stroke at a rapid repetition rate, and may be used with a standard source of pressurized air.

The impact tool in accordance with the present invention broadly includes a hand-held impact device having a cylindrical, hollow body and a piston shiftably received within the body, conduit for directing and venting motive fluid to and from the hand-held device for shifting of the piston therein, and a valve for alternatively, operably coupling the directing and venting conduit to the hand-held device at a variable, rapid rate. In more detail, the valve includes a valve body and a rotor rotatably received within the valve body. The rotor and the valve body each have cooperative motive fluid channels for connecting the directing conduit and venting conduit to the hand-held device at a cylindrical rate that exceeds the rotation rate of the rotor. In particularly preferred forms, the rotor includes a diametrically oriented channel, and the valve body includes three inlet channels and an internal connecting channel in communication with one of the inlet channels. The diametrically oriented channel rotates with the rotor for alternatively, individually connecting the one outlet channel to the other two inlet channels via the connecting channel.

BRIEF DESCRIPTION OF THE DRAWINGS

FIG. 5 is a top view of the control box of the present invention with the uppermost panel removed for clarity;

FIG. 6 is a fragmentary top view of the foot pedal of the impact tool in accordance with the present invention;

FIG. 7 is a sectional view taken along the line 7—7 of FIG. 6;

FIG. 8 is a sectional view of the hand-held impact device of the impact tool in accordance with the present invention; and FIG. 9 is a sectional view of an alternative embodiment of the hand-held impact device.

DESCRIPTION OF THE PREFERRED EMBODIMENT

Figure 1:
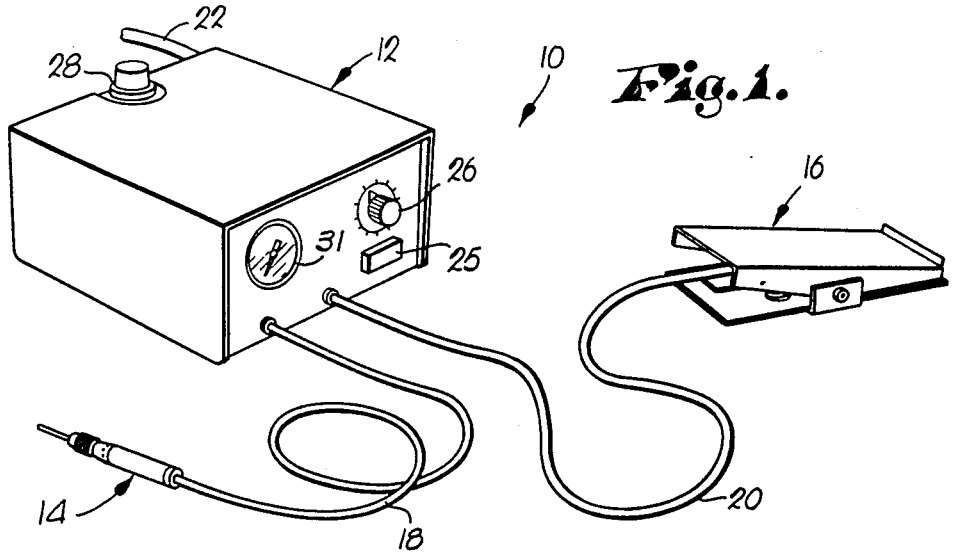
FIG. 1 is a perspective view of the impact tool in accordance with the present invention.

Referring to the drawings, an impact power tool 10 in accordance with the present invention broadly includes a control box 12, an impact device 14, and a foot pedal 16. The impact device 14 is connected to the control box 12 by motive fluid conduit 18, and the foot pedal is connected to the control box by motive fluid conduit 20. An air compressor 21 or other source of high pressure motive fluid is provided to the control box via conduit 22.

In more detail, and referring to FIG. 5, the control box 12 includes a variable speed electric motor 24 and an associated electronic speed control 26 for the motor 24. Electrical power is delivered to the motor via on-off switch 25. The control box 12 also houses a pressure regulating valve 28 to which a source of high pressure motive fluid is connected via conduit 22. The regulating valve 28 is connected via conduit 30 to a pressure indicating gauge 31. A rotary valve 32 is supported on rotor 25 of motor 24. A conduit 34 directs motive fluid from the pressure regulating valve 28 to the rotary valve 32. Conduit 36 vents motive fluid from valve 32 to the front panel of the control box 12 where it is connected by nipple 38 to conduit 20 leading to the foot pedal 16. Conduit 40 connects rotary valve 32 to the front panel of control box 12 where it is connected by nipple 42 to conduit 18 leading to the impact device 14.

Rotary valve 32 includes a tubular valve body 44 having an outer, metallic sleeve 46 and an inner, self-lubricating sleeve 48 fixedly force-fitted within the outer sleeve 46. The valve body 44 includes three inlet channels 50, 52, 54 within which conduit coupling nipples 56, 58, 60 are threadably received. Valve 32 includes a rotor within inner sleeve 48 that is fixedly attached to the motor rotor 25. A diametrically oriented channel 64 is bored through the valve rotor 62 for alignment with the valve body channels 50, 52, 54. A retaining washer 66 is held in place at the end of valve rotor 64 by screw 68. A retaining bushing 70 is held in place on the valve rotor 62 by set screw 72.

Foot pedal 16 has a lowermost base plate 74 that includes a pair of upstanding ears 76, 78. A horizontally oriented shaft 80 is pivotally supported by the ears 76, 78. An uppemost, foot-receiving plate 82 is fixedly secured to shaft 80 by nuts 84, 86. A sleeve 88 is fixedly supported on shaft 80 for pivotal motion therewith by set screw 84. The sleeve 88 includes a centered, V-shaped notch 90 of varying depth extending approximately half way around the circumference of the sleeve. An angled support 92 is attached to the base plate 74, and supports a metallic conduit 94. Conduit 20 is received at one end of the conduit 94, and the opposite end of conduit 94 supports a block 96. Block 96 includes a bored through channel 98 aligned with conduit 94 and a concave surface 100 for receiving sleeve 88. Block 100 is biased against sleeve 88 by spring 102. The foot pedal upper plate 92 is spring biased to a rest position by spring 104. It will be noted that when plate 82 is biased to the rest position, sleeve 88 blocks the opening of channel 98 in block 96 in fluid sealing relationship.

The hand-held impact device 14 includes a cylindrical body 106 with an impact receiving member 108 threadably received in one end thereof. The body 106 includes an innermost chamber within which the piston 110 is shiftably received. Piston 10 is shiftable along a stroke length between an extended or rest position spaced apart from the impact member 108 and an impact position wherein the piston 110 engages the impact member 108. Piston 110 is biased towards its extended position by spring 112. Piston 110 includes a plurality of circumferential grooves 114 therearound. Fitting 116 is threadably received at the end of body 106 opposite impact member 108, and supports the end of conduit 18. A gasket 118 is interposed between the fitting 116 and the body 106 of impact device 14. Radially extending ports 120 communciate the inner chamber of body 106 with the atmosphere.

Referring to FIG. 9, a second embodiment of the hand-held impact device 14' is depicted. Impact device 14' is similar in many respects to the impact device 14, and parts of the device 14' similar to that in 14 are denoted by similar numbers. It will be noted that impact device 14' is adapted for more heavy duty applications than the first embodiment of the hand-held impact device described above, and is somewhat larger than the first embodiment. It will also be noted that piston 110' includes a hollowed out center filled with weighted material 122. The weighted material 122 is held in place within the piston 110' by threadably received end cap 124.

In operation, control box 12 is connected to a source of high pressure motive fluid such as air via conduit 22. The high positive pressure air is regulated to a suitable pressure, such as 30 psi, by regulator valve 28. The regulated pressure is indicated by gauge 31 on the front panel of control box 12.

Figure 2:
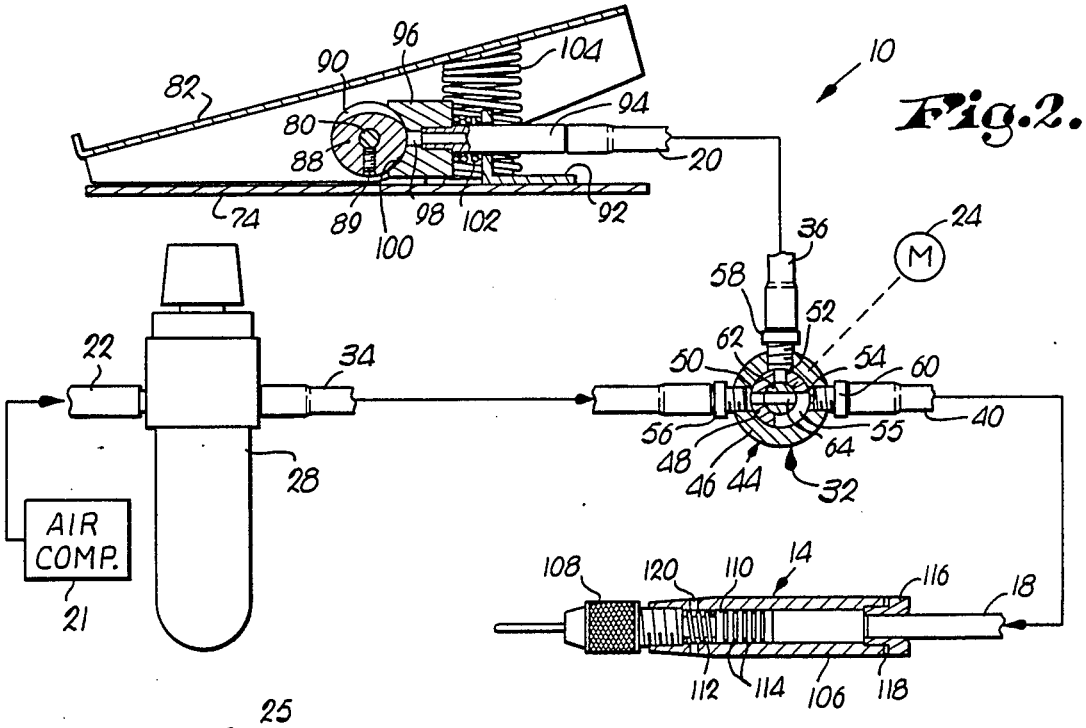
FIG. 2 is a partially schematic, sectional view of the impact tool in accordance with the present invention.
Figure 3:
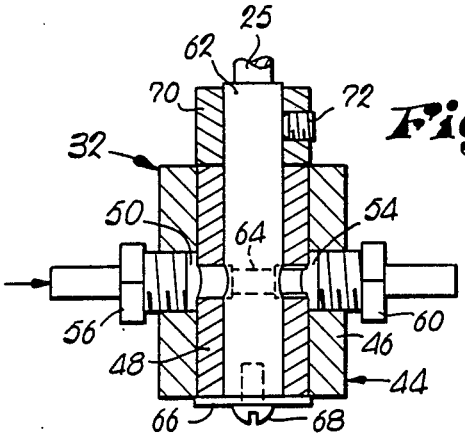
FIG. 3 is a horizontal sectional view of the rotatable valve of the present invention.
Figure 4:
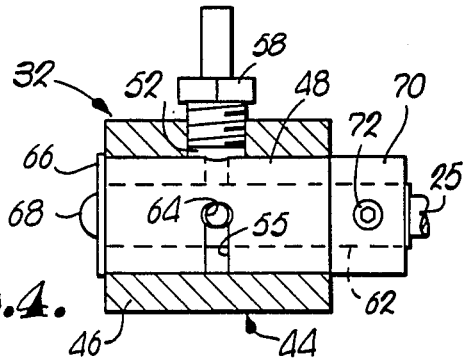
FIG. 4 is a vertical sectional view of the rotatable valve in accordance with the present invention.

The motive fluid is transmitted to valve 32 from the regulator valve 28 via conduit 34. The rotor 48 of valve 32 is rotated by motor 24. When the rotor is aligned as depicted in FIG. 2, motive fluid will be transmitted via channel 50 of valve 32 through channel 64 of rotor 48 to channel 54 of valve 32 and thence to the impact device 14 via conduit 18. The piston 110 will be shifted to its impact position within the body 106 of handheld device 14 under the influence of the motive fluid delivering an impulse of impact energy to the member 108.

Channel 54 of the valve 32 will be connected to channel 52 of valve 32 via connecting channel 55 and rotor channel 64 when the rotor 62 is oriented 90 degrees from the position depicted in FIG. 2, thereby connecting the hand-held device 14 and foot pedal 16 via motive fluid conduits. Rotation of the upper plate 82 of the foot pedal 16 will align a portion of notch 90 with the channel 98 of block 96, thereby permitting motive fluid to vent from the hand-held device 14 through conduit 18, valve 32, conduit 36 and conduit 20 to the atmosphere. It will be appreciated that as plate 82 of foot pedal 16 is rotated further, more of the notch 90 will be aligned with channel 98 of block 96, and motive fluid will be vented from the hand held device 14 at a more rapid rate.

The unique channeling means of valve 32 aligns channel 54 in alternative fashion with channel 50 and channel 52 via connecting channel 55 and rotor channel 64 every 90 degrees of rotation of the rotor 62. In this manner, motive fluid is directed to and vented from hand-held device 14 at a cyclical rate that is twice the rotation rate of the rotor 62. An electric motor 24 having a rotation rate of 1,000 rpm's for instance, will, through the use of valve 32, cause the piston 110 of hand-held device 14 to cycle between the impact position and extended position 2,000 times per minute.

It will be noted that if the upper plate 82 of foot pedal 16 is retained in its rest position, notch 90 of sleeve 88 will remain unaligned with the output channel 98 of block 96, and no motive fluid will be vented from the hand-held device 14 even when the rotor 62 communicates output channel 98 of foot pedal 16 with the hand-held device 14. It will also be appreciated that, even with the notch 90 fully aligned with the output channel 98 of block 96, motive fluid will vent from the hand-held device 14 only so long as channel 52 of valve 32 communicates with channel 54 of valve 32 via rotor channel 64 and connecting channel 55. Piston 110 will therefore not be able to fully return to its extended position from its impact position if rotor 62 is rotated at such a rate that rotor channel 64 is out of alignment with channel 52 prior to the venting of all the motive fluid from the device 14.

The above described characteristic of the impact power tool 10 may be used to set an upper limit on the impact energy provided by each stroke of the piston. That is to say, prior to engraving or stone setting operations, plate 82 of the foot pedal 16 may be rotated to fully align notch 90 with output channel 98, and speed control 26 can be used to determine the rotation rate of motor 24 and rotor 52 of valve 32. Once the rotation rate of the rotor 52 is set in this manner, the distance the piston 110 can travel from its compact position towards its extended position will be at its maximum, since when the notch 90 of sleeve 88 is less than fully aligned with channel 98 of block 96, less motive fluid will be vented from the device 14 through foot pedal 16 than when the notch 90 is fully aligned with output channel 98. The less distance piston 110 travels, the less impact energy it can deliver to member 108, and the operator of the impact tool 18 can in the above described manner set the maximum amount of impact energy delivered by each stroke of piston 110.

It will also be appreciated by those skilled in the art that the impact power tool herein described may be operated by connection to any conventional source of pressurized air. That is to say, previous impact power tools designed for use in delicate handworking operations required a special motive fluid source that could provide both a positive and negative pressure to the hand-held impact device. The tool herein described, however, requires that the hand-held device 14 be provided only with motive fluid pressurized to a level above the ambient atmosphere for shifting of the piston 110 within the body 106 of the hand-held device 14 from its rest position to its impact position. The piston 110 is returned towards its rest position from its impact position when the pressure within the body 106 of the device 14 is reduced below the above-described raised pressure level.

I claim:

1. An impact power tool for use in delicate hand-working operations including:

a hand-held device having a tubular body presenting a bore and having a first tool mounting end and a second closure end, said body being provided with a member adjacent said first end for supporting an impact transmitting work tool projecting from the body, a piston received within said bore shiftable along a stroke length between an impact position engaging said member and any one of a number of extended positions between said member and said second end, said bore defining a first portion between said piston and said first end of the bore and a second variable length portion between said piston and said second end of said bore, the length of said second portion of the bore varying as a function of the disposition of the piston in the extended positions therein;

spring means within said first bore portion of the body for biasing said piston toward said second end of the bore;

a source of motive fluid pressurized to a certain, maximum positive value;

means coupling said source of motive fluid to said body for communication with said second bore portion thereof for maintaining a positive pressure condition at all times within said second portion of the bore during use of said device and for direct impingement of said motive fluid on said piston, said body being provided with port means therein operable to maintain fluid communication of said first portion of said bore with the atmosphere during operation of the device, said certain, positive pressure value of the fluid of said source being sufficient to cause the pressurized fluid to overcome the bias of said spring means and effect shifting of said piston toward and into said impact position thereof engaging said member; and means for intermittently, cyclically, lowering the pressure of said motive fluid in said second portion of said bore to any one of a number of reduced, preselected levels each of which is below said maximum value and above atmospheric and each of which allows the spring means to return the piston from said impact position to an extended position which is determined by the magnitude of the reduced pressure level, each of said reduced pressures being sufficient to overcome the bias of said spring means as said piston moves toward said end of the body to interrupt such movement and restrict the piston to an extended position preventing said piston from shifting fully to said second end, said pressure lowering means including selectively positionable means being movable by the tool user into selected positions each of which causes the pressure of said motive fluid in said second portion of the bore to be reduced to a different, reduced level which is above atmospheric pressure, thus allowing selective variation of the distance of said extended position from said impact position depending on the position of the selectively positionable means in order to vary the amount of impact energy imparted to said impact member by said piston during travel thereof into said impact position.

2. An impact power tool as claimed in claim 1, said coupling means comprising valve means, including a valve body and a rotor rotatably received within said valve body, said rotor and said valve body each having cooperative motive fluid channel means for operably connecting said source of motive fluid and said selectively positionable means to said device at a cyclical rate during rotation of the rotor.

3. An impact power tool as claimed in claim 2, said rotor including a diametrically oriented channel, said valve including three inlet channels and an internal connecting channel in communication with one of said inlet channels, said diametrically oriented channel rotatable with said rotor for alternatively, individually connecting said one inlet channel to said remaining inlet channels via said connecting channel.

4. An impact power tool as claimed in claim 2, including a variable speed motor operably connected to said valve means for rotation of said rotor relative to said valve body.

5. An impact power tool as claimed in claim 1, said selectively positionable means including means for infinitely varying within limits the reduction of pressure of positive motive fluid, in said second portion of said bore and thereby providing infinite control of the distance between said impact position and said extended position.

6. An impact power tool as claimed in claim 5, said selectively positionable means including a conduit having a discharge end and foot actuated means for changing the open surface area of said discharge end.

* * * * *